US005687747A

United States Patent [19]

Schramm

[11] Patent Number: 5,687,747

[45] Date of Patent: Nov. 18, 1997

[54] METHOD OF AND APPARATUS FOR ASSEMBLING ACCUMULATIONS OF PARTICULATE MATERIALS

[75] Inventor: Christian Schramm, Evry, France

[73] Assignee: Chilinov s.a.r.l., Chilly-Mazarin, France

[21] Appl. No.: 528,240

[22] Filed: Sep. 14, 1995

[30] Foreign Application Priority Data

Sep. 22, 1994 [DE] Germany ..... 44 33 848.1

[51] Int. Cl.[6] ..... A24C 5/14

[52] U.S. Cl. ..... 131/280; 131/70; 131/72; 131/108; 141/72; 141/74; 141/75; 198/604

[58] Field of Search ..... 131/70, 72, 108, 131/280; 141/72, 74, 75; 198/604

[56] References Cited

U.S. PATENT DOCUMENTS 2,551,095 5/1951 Chaze ..... 131/70

5,141,003 8/1992 Dawson et al. ..... 131/108

FOREIGN PATENT DOCUMENTS 2187928 9/1987 United Kingdom ..... 131/108

*Primary Examiner*—V. Millin

*Attorney, Agent, or Firm*—Darby & Darby

[57] ABSTRACT

Particles of comminuted smokable material are loosened in a downwardly converging compartment defined by a funnel-shaped array of intermittently driven endless flexible belts. The outlet at the lower end of the compartment delivers flows of loosened material into a receptacle wherein the level of the material is monitored and a motor for the belts is started to admit additional material into the receptacle when the level of material descends below a predetermined minimum level. The bottom portion of the reservoir can be expanded and contracted to convert the lowermost part of material in the receptacle into a succession of properly compacted batches each of which can constitute a rod-like filler, and such batches are thereupon evacuated longitudinally of the bottom portion of the receptacle into successive empty tubular envelopes which can be made of cigarette paper or other wrapping material for rod-shaped smokers' products.

30 Claims, 2 Drawing Sheets

METHOD OF AND APPARATUS FOR ASSEMBLING ACCUMULATIONS OF PARTICULATE MATERIALS

BACKGROUND OF THE INVENTION

The invention relates to improvements in methods of and in apparatus for assembling accumulations of particulate materials, and more particularly to improvements in methods of and apparatus for making batches of comminuted material, such as fragments of tobacco leaf laminae, fragments of tobacco ribs, particles of comminuted sheets or foils of reconstituted tobacco and/or fragments of substitute tobacco. Still more particularly, the invention relates to improvements in methods of and apparatus for making batches of comminuted material in a receptacle which receives comminuted material from a transporting system.

It is already known to introduce comminuted smokable material into a receptacle wherein the material is gathered into a succession of batches. A drawback of presently known methods and apparatus is that the condition of the comminuted material which enters the batch forming receptacle is not sufficiently predictable as well as that the rate of admission of comminuted material into the receptacle is likely to fluctuate within an undesirably wide range.

OBJECTS OF THE INVENTION

An object of the invention is to provide a novel and improved method of preparing comminuted material, such as comminuted smokable material, for gathering into batches of optimum size, density and/or other desirable characteristics.

Another object of the invention is to provide a method which renders it possible to turn out high-quality batches of comminuted material at a high frequency.

A further object of the invention is to provide a novel and improved method of transporting comminuted material to a batch forming station.

An additional object of the invention is to provide a novel and improved method of treating batches prior to further processing, e.g., prior to introduction into tubular envelopes.

Still another object of the invention is to provide a novel and improved mode of loosening comminuted material on its way toward the batch forming station.

A further object of the invention is to provide a novel and improved apparatus for the practice of the above outlined method.

Another object of the invention is to provide the apparatus with novel and improved means for treating comminuted material on its way toward the batch forming location or locations.

An additional object of the invention is to provide the apparatus with novel and improved means for forming a succession of batches and for expelling successive batches from the batch forming location.

Still another object of the invention is to provide the apparatus with a novel and improved transporting system for comminuted material, such as fragments and/or other particles of natural, reconstituted and/or artificial tobacco.

SUMMARY OF THE INVENTION

One feature of the present invention resides in the provision of a method of making batches of comminuted material. The improved method includes the step of transporting comminuted material into a receptacle of a batch gathering unit by resorting to a substantially funnel-shaped array of at least intermittently driven endless flexible elements. At least one of the flexible elements can constitute an endless belt. The material of the batches is or can be a comminuted smokable material such as shreds and/or otherwise configurated fragments of tobacco leaf laminae, fragments of tobacco ribs, fragments of sheets or foils of reconstituted tobacco and/or fragments of artificial tobacco.

The method preferably further comprises the steps of placing the receptacle beneath the array of flexible elements and positioning the flexible elements of the array in such a way that the flexible elements define a path having a cross-sectional area decreasing downwardly toward the receptacle, i.e., such path can diverge upwardly in a direction away from the at least partially open top of the receptacle.

The method further comprises the steps of establishing and maintaining a relatively large supply of comminuted material within the funnel-shaped array of flexible elements, at least intermittently driving at least one first flexible element of the array in a first direction, and at least intermittently driving at least one second flexible element of the array in a second direction other than the first direction. The step of at least intermittently driving the at least one first flexible element of the array can include causing the at least one first flexible element to advance comminuted material of the supply from a higher level to a lower level (i.e., with a component of downward movement), and the step of at least intermittently driving the at least one second flexible element can include causing the at least one second flexible element to advance comminuted material of the supply from a lower level to a higher level, i.e., with a component of upward movement).

The method preferably further comprises the step of positioning at least two flexible elements of the array relative to each other at an angle such that the at least two flexible elements loosen the supply of comminuted material within the array. In other words, the method can comprise (and preferably comprises) the step of loosening the supply of comminuted material within the array. In addition to or in lieu of loosening the supply with the at least two flexible elements, the loosening step can include agitating the comminuted material of the supply by a rotary eccentric loosening implement. For example, the implement can include at least one substantially plate-like agitator (such as a vane-like part) eccentrically affixed to or forming part of a rotary carrier, e.g., a horizontal shaft extending into the supply of comminuted material within the array of flexible elements.

The method preferably further comprises the steps of accumulating a relatively large quantity of comminuted material in the receptacle, evacuating batches of comminuted material from the receptacle with attendant depletion of the quantity of comminuted material in the receptacle, monitoring the quantity of comminuted material in the receptacle, and driving the flexible elements to transport comminuted material from the supply within the array of flexible elements into the receptacle when the quantity of comminuted material in the receptacle is depleted to a predetermined minimum value. The monitoring step can include photoelectronically monitoring the quantity of comminuted material in the receptacle.

The transporting step can include supplying comminuted material to an elongated bottom portion of the receptacle, namely a bottom portion having a length at least approximating the length of a rod-shaped smokers' product (such as a plain or filter cigarette). Such method can further comprise the step of compacting the comminuted material in the bottom portion of the receptacle to form batches having a density at least approximating that of a rod-like filler in a cigarette or another rod-shaped smokers' product. Still further, such method can comprise the step of evacuating or expelling batches from the receptacle into tubular envelopes (e.g., into envelopes containing cigarette paper or other suitable wrapping material for comminuted smokable material). The evacuating or expelling step preferably includes moving the batches at least substantially longitudinally of the bottom portion of the receptacle.

Another feature of the invention resides in the provision of an apparatus for making batches of comminuted material. The improved apparatus comprises a batch gathering unit including a receptacle for comminuted material, and means for transporting comminuted material into the receptacle including a substantially funnel-shaped array of at least intermittently driven endless flexible elements. As already mentioned hereinabove, at least one of the flexible elements can include or constitute an endless flexible belt and the comminuted material can constitute comminuted smokable material such as fragments of tobacco leaf laminae, tobacco ribs, reconstituted tobacco and/or artificial tobacco.

The receptacle is or can be disposed beneath the array of flexible elements and the flexible elements of the array then preferably define a path having a cross-sectional area decreasing downwardly toward the receptacle and preferably dimensioned to define or constitute a compartment for a relatively large supply of comminuted material.

The transporting means can further include at least one drive for the flexible elements of the array; such at least one drive can include means for at least intermittently driving at least one first flexible element of the array in a first direction and means for at least intermittently driving at least one second flexible element of the array in a second direction other than the first direction. The means for at least intermittently driving the at least one first flexible element of the array can include means for causing the at least one first flexible element to advance comminuted material of the supply in the aforementioned compartment from a higher level to a lower level, and the means for at least intermittently driving the at least one second flexible element of the array can include means for causing the at least one second flexible element to advance comminuted material of the supply from a lower level to a higher level. This results in satisfactory intermixing and loosening of comminuted material forming the supply in the aforementioned compartment.

At least two flexible elements of the array can be positioned relative to each other at an angle such that the at least two flexible elements loosen the supply of comminuted material in the compartment. Alternatively or in addition to the just outlined positioning of the at least two flexible elements relative to each other, the apparatus can comprise mobile means for loosening the supply of comminuted material in the compartment. Such loosening means can comprise a rotary carrier (e.g., a horizontal shaft extending into the compartment) and at least one substantially plate- or vane-like loosening implement which is eccentrically affixed to the carrier.

The receptacle is arranged to accumulate a quantity (e.g., a relatively large quantity) of comminuted material, and the batch gathering unit can further comprise means for evacuating or expelling batches of comminuted material from the receptacle with attendant depletion of the qantity of comminuted material in the receptacle. Such apparatus can further comprise means for monitoring the quantity of comminuted material in the receptacle and for activating at least one drive for the flexible elements to transport comminuted material into the receptacle in response to depletion of the quantity of comminuted material in the receptacle to a predetermined minimum value.

As already mentioned before, the transporting means can include means (such as the at least two flexible elements) for loosening comminuted material prior to introduction of such material into the receptacle.

Still further, the apparatus can comprise means for varying the capacity (e.g., the width, the depth and/or the height) of the receptacle and/or for varying the dimensions of that (preferably bottom) portion of the receptacle which receives comminuted material for the making of a series of batches.

The apparatus can also comprise means for compacting batches of comminuted material in the bottom portion of the receptacle, e.g., to a density at least approximating that of a filler in a cigarette or another rod-shaped smokers' product. The compacting means can cooperate with or include or form part of means for evacuating or expelling compacted batches from the bottom portion of the receptacle, preferably at least substantially longitudinally of the elongated bottom portion. The means for evacuating or expelling batches from the bottom portion of the receptacle can include means for introducing evacuated batches of comminuted material into tubular envelopes, e.g., into elongated hollow cylinders which are made of or contain wrapping material (such as cigarette paper) for fillers of smokable comminuted material.

The novel features which are considered as characteristic of the invention are set forth in particular in the appended claims. The improved apparatus itself, however, both as to its construction and the mode of using the same, together with additional features and advantages thereof, will be best understood upon perusal of the following detailed description of certain presently preferred specific embodiments with reference to the accompanying drawings.

DESCRIPTION OF PREFERRED EMBODIMENTS

Figure 1:
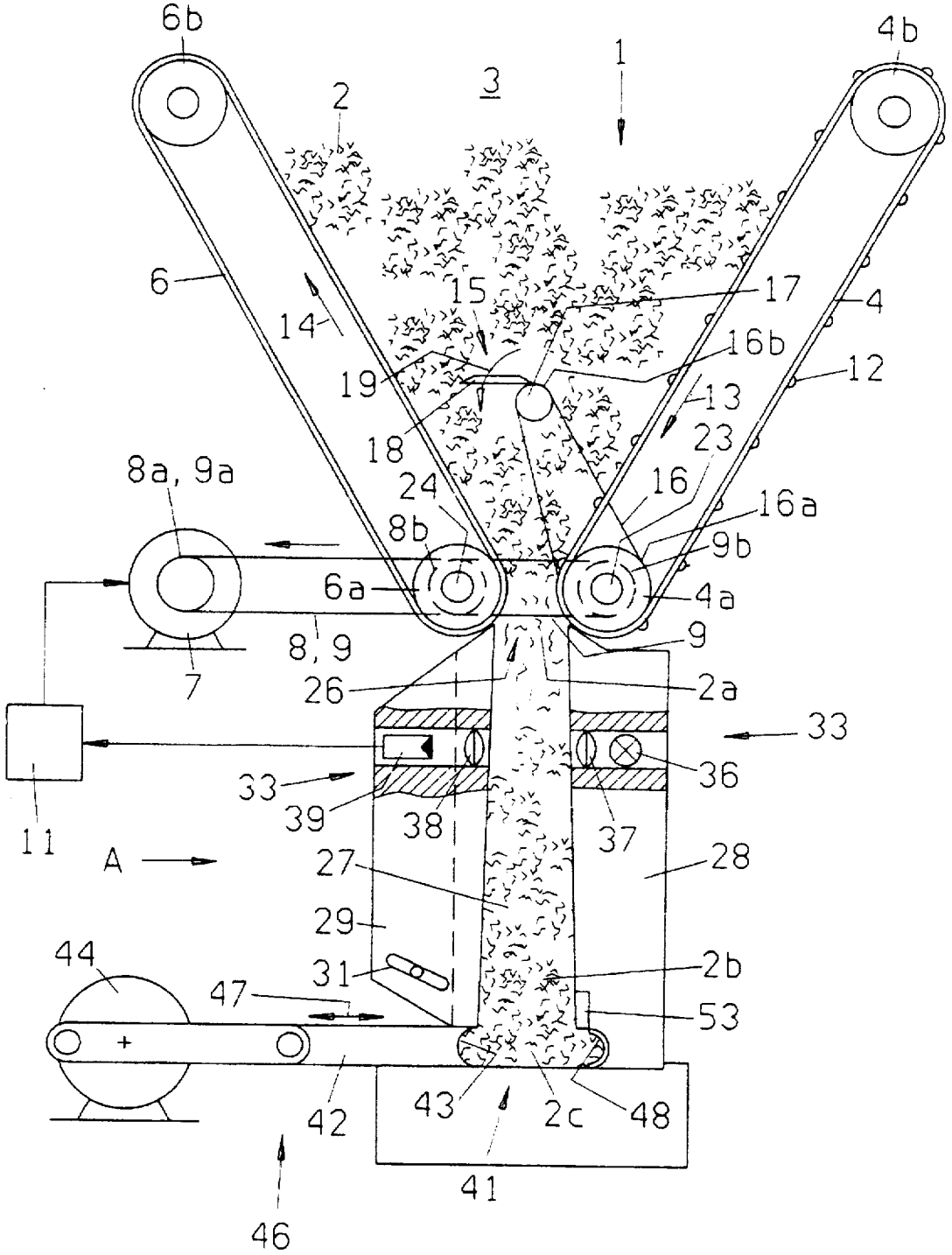
FIG. 1 is a partly elevational and partly vertical sectional view of an apparatus which embodies one form of the invention.
Figure 2:
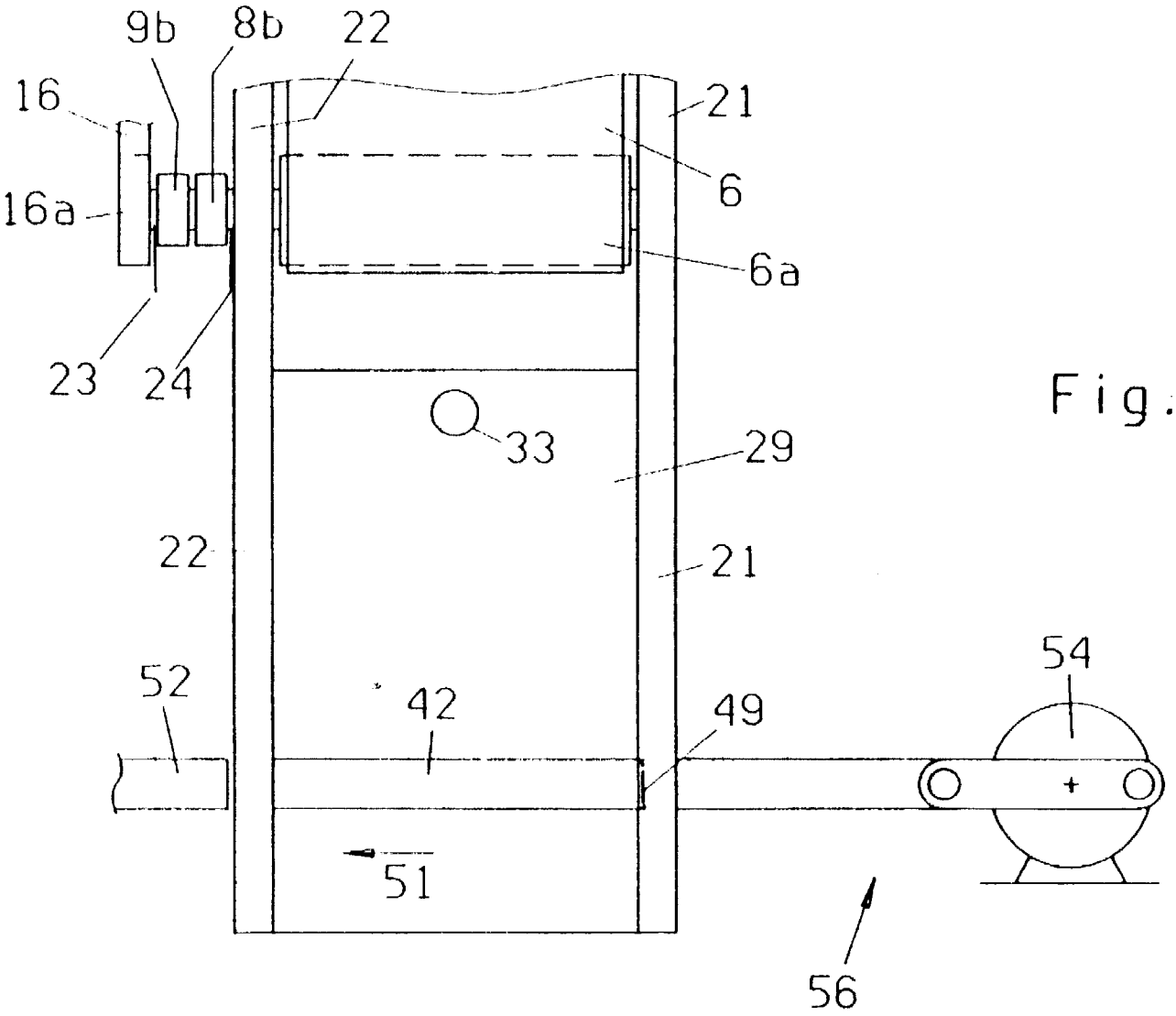
FIG. 2 is a fragmentary view as seen in the direction of arrow A in FIG. 1.

The apparatus 1 which is shown in FIGS. 1 and 2 comprises a funnel-shaped array 3 of endless flexible elements, e.g., in the form of endless belts. FIG. 1 shows two endless belts 4, 6 but at least one of these belts can comprise two or more narrower belts disposed one behind the other as seen in FIG. 1. The array 3 of belts 4 and 6 defines an upwardly diverging compartment for a supply 2 of comminuted material, for example, fragments of tobacco leaf laminae, tobacco ribs, sheets or foils of reconstituted tobacco and/or substitute or artificial tobacco. For example, the supply 2 can contain a mixture of two or more different types of comminuted smokable material.

The endless belts 4, 6 form part of a transporting system which further comprises means for intermittently driving the belts 4, 6 in directions respectively indicated by arrows 13, 14, i.e., in different directions. The means for intermittently driving the belt 4 comprises pulleys 4*a*, 4*b*, a horizontal shaft 23 for the pulley 4*a*, an electric motor 7, a toothed pulley 9*a* on the output shaft of the motor 7, a toothed pulley 9*b* on the shaft 23, and an endless toothed belt 8 which is trained over the toothed pulleys 9*a*, 9*b*. The electric motor 7 can be replaced by any other suitable prime mover, e.g., by a pneumatic or hydraulic motor. Furthermore at least one of the belts 4, 6 can constitute a toothed belt and the corresponding pulleys 4*a*, 4*b* and/or 6*a*, 6*b* then constitute toothed pulleys.

The means for intermittently driving the belt 6 comprises the aforementioned pulleys 6*a*, 6*b*, a shaft 24 for the pulley 6*a*, a toothed pulley 8*a* on the output shaft of the motor 7, a toothed pulley 8*b* on the shaft 24, and an endless toothed belt 8 which is trained over the toothed pulleys 8*a*, 8*b*. The motor 7 receives signals to set the belts 4, 6 in motion or to arrest such belts from a control circuit 11. In its simplest form, the circuit 11 comprises an on-off switch which receives signals from the photoelectronic transducer 39 of a monitoring device 33 for the quantity of comminuted particles 2*a* in a receptacle 27 disposed at a level below the downwardly converging path defined by the confronting reaches of the belts 4, 6 and constituting or forming part of the aforementioned compartment for the supply 2 of comminuted particles within the array 3.

The external surface of the belt 4 is provided with preferably equidistant entraining elements 12 which promote a downward movement of adjacent particles forming the supply 2 when the motor 7 is on to drive the toothed belt 9. The particles which are adjacent the left-hand reach of the belt 4 then advance in a direction to have a component of movement from a higher level to a lower level, namely toward the inlet 26 to the receptacle 27; such inlet is located between those portions of the belts 4 and 6 which are respectively trained over the pulleys 4*a* and 6*a*. At the same time, the motor 7 drives the belt 6 in a direction to ensure that the particles of the supply 2 adjacent the right-hand reach of the belt 6 have a component of movement in an upward direction, i.e., away from the inlet 26. The belt 6 can also comprise entraining elements which may but need not be identical with the entraining elements 12 of the belt 4.

It is equally within the purview of the invention to move the right-hand reach of the belt 6 in a downward direction and to move the left-hand reach of the belt 4 in an upward direction, as viewed in FIG. 1. The feature that the belts 4, 6 are or can be driven in different directions enhances the loosening and intermixing action of these belts upon the contents of the supply 2 of particles in the funnel-shaped array 3.

The shaft 23 for the pulleys 4*a*, 9*b* carries a further toothed pulley 16*a* and a horizontal shaft 17 in the compartment for the supply 2 carries a toothed pulley 16*b*. A toothed endless belt 16 which is trained over the pulleys 16*a*, 16*b* serves to rotate the shaft 17 which constitutes a rotary carrier for an eccentrically mounted plate- or vane-like agitating implement 18 between the belts 4 and 6. The direction of rotation of the carrier 17 when the motor 7 is on is indicated by an arrow 19. The carrier 17 and the implement 18 constitute a relatively simple but highly effective and reliable agitating device 15 for the supply of comminuted particles which are to be converted into a series of batches 2*c* in the bottom portion 41 of the receptacle 27 and which are to enter the inlet 26 in a properly loosened condition.

The ratio of the transmission including the toothed pulleys 16*a*, 16*b* and the toothed belt 16 is preferably such that the carrier 17 is rotated at a speed at least slightly (but preferably considerably) exceeding the RPM of the shaft 23. The angle between the confronting reaches of the belts 4, 6 is selected as a function of the RPM of the carrier 17 or vice versa to ensure that the confronting reaches of the belts 4, 6 also contribute to agitation and loosening of particles forming the supply 2 in the funnel-shaped array 3.

The transporting system including the belts 4, 6 further includes parallel upright walls 21, 22 (FIG. 2) which bound the supply 2 from the front and from the rear as viewed in FIG. 1. The walls 21, 22 can be made of light-transmitting (transparent or translucent) plastic or other material. The particles of the flow 2*a* entering the receptacle 27 via inlet 26 between the pulleys 4*a*, 6*a* can form a shower which gathers in the receptacle to form a quantity of loosened smokable particles ready to be densified in the bottom portion 41 in order to form a series of elongated rod-like batches 2*c* adapted to be evacuated or expelled from the receptacle 27.

The receptacle 27 is formed by the lower portions of the walls 21, 22 and by two additional walls 28, 29. At least one of the walls 21, 22, 28, 29 preferably forms part of means for varying the capacity of the receptacle 27. As shown in the lower portion of FIG. 1, the wall 29 is provided with a suitably inclined slot 31 for a stationary guide pin so that the wall 29 can move toward or away from the wall 28 (substantially in directions indicated by a double-headed arrow 47) in order to thus select the capacity or volume of the receptacle 27. The means for releasably fixing the wall 29 in a selected position relative to the walls 21, 22 and 28 is not shown in the drawings. It is also possible to simply pivot the wall 29 about the pin in the slot 31 and to thus vary the capacity of the reservoir 27.

The aforementioned monitoring device 33 serves as a means for limiting the fluctuations of the upper surface of the quantity of comminuted particles 2*b* in the receptacle 27. The device 33 includes a radiation source 36 (e.g., a light source) in a hole of the wall 28, the aforementioned photoelectronic transducer 39 in a hole or bore of the wall 29, and suitable optical elements 37, 38 between the radiation source 36 and the transducer 39. When the upper surface of the quantity of particles 2*b* in the reservoir 27 descends below the level of the optical elements 37, 38, the transducer 39 transmits to the control circuit 11 a signal which starts the motor 7 so that the belts 4, 6 begin to supply a shower 2*a* of particles from the supply 2 to thus increase the quantity .of particles 2*b* in the reservoir. The motor 7 is brought to a halt when the quantity of particles 2*b* increases so that such particles interrupt the beam of radiation between the source 36 and the transducer 39. In this manner, the quantity of particles 2*b* can fluctuate only within a relatively narrow range. The transducer 39 can constitute or include a customary photodiode. It is also possible to utilize signals from the transducer 39 to the circuit 11 to set the motor 7 in operation for a preselected interval of time which is sufficient to ensure that the receptacle 27 receives a predetermined quantity of particles from the supply 2. It has been found that the particles 2*b* in the receptacle 27 are in optimum condition for compacting into batches 2*c* if the particles of the supply 2 are adequately loosened in the compartment defined by the array 3 and if the upper level of the quantity of particles 2*b* in the receptacle fluctuates only within a relatively narrow range.

The means for densifying batches 2*c* in the bottom portion 41 of the receptacle 27 includes a pusher 42 having a front face provided with a flute 43 bounded by a substantially semicylindrical concave surface. A similar substantially semicylindrical concave surface is provided in a fixed flute 48 which is formed in the wall 28 and confronts the flute 43.

The pusher 42 is reciprocable in directions indicated by the double-headed 47 by a prime mover 44, e.g., an electric motor, which is coupled to the pusher by a suitable linkage 46, e.g., a crank drive.

The length of the bottom portion 41 between the walls 21, 22 preferably equals or approximates the length of a tobacco filler in a cigarette or another rod-shaped smokers' product which is to receive a batch 2*c*.

When the pusher 42 is caused to perform a forward stroke toward the wall 28, it condenses the batch 2*c* between the surfaces of the flutes 43, 48 so that the thus densified batch constitutes a rod-like filler which is ready to be introduced into an elongated tubular envelope, e.g., an envelope made of cigarette paper or other suitable wrapping material for fillers of comminuted smokable material.

A knife 53 on the wall 28 automatically removes the surplus of particles which project beyond the elongated cylindrical space formed by the flutes 43, 48 when the densifying action is completed, i.e., when the bottom portion 41 of the receptacle 27 contains a rod-like batch 2*c* which is ready for evacuation in the longitudinal direction of the bottom portion 41. The direction of evacuation of a freshly formed compacted batch 2*c* (the density of which preferably equals or approximates the density of a rod-like filler in a cigarette or another rod-shaped smokers' product) is indicated in FIG. 2 by the arrow 51. The flute 48 is provided with a closure 49 (shown in FIG. 2). The expelling device 56 is driven by a motor 54 and moves a freshly completed batch 2*c* along the pusher 42 (which acts as guide) and into a tubular envelope 52 of cigarette paper or other suitable wrapping material for rod-like fillers of particulate smokable material.

When the introduction of a batch 2*c* into the aligned tubular envelope 52 is completed, the pusher 42 is retracted by the motor 44 and the crank drive 46, and the bottom portion 41 is ready to receive a part of the quantity of comminuted material 2*b* from the adjacent portion of the receptacle 27, normally by gravity flow. The pusher 42 is thereupon caused to carry out a forward stroke in order to form a fresh batch 2*c* which is adequately condensed for introduction into an empty tubular envelope 52.

An advantage of the improved method and apparatus is that the comminuted particles of the supply 2 in the compartment of the array 3 are adequately loosened prior to descending into the receptacle 27. For example, the flow 2*a* leaving the compartment via passage 26 can contain a mass of particles which are at least nearly completely separated from each other. This is desirable for the homogeneousness of the batches 2*c*.

Another advantage of the improved method and apparatus is that the height of the quantity of particulate material in the receptacle 27 is permitted (by the monitoring device 33) to fluctuate only within a relatively narrow range. This, too, is desirable and advantageous for the quality of batches 2*c* which are evacuated from the bottom portion 41 of the receptacle 27 for introduction into successive empty tubular envelopes 52.

The feature that at least one wall (such 29) of the receptacle 27 is adjustable contributes to versatility of the apparatus.

The apparatus of the present invention can be utilized with advantage in combination with the apparatus which is disclosed in the commonly owned copending U.S. patent application Ser. No. 08/528,239 filed on Sep. 14, 1995 for "Method of and apparatus for evacuating arrayed tubular objects from containers". The apparatus of the copending patent application can be utilized to deliver successive tubular objects or envelopes to the position (filling station) occupied in FIG. 2 by the envelope 52. The disclosure of the copending patent application is incorporated herein by reference.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art and, therefore, such adaptations should and are intended to be comprehended within the meaning and range of equivalence of the appended claims.

What is claimed is:

1. A method of making batches of comminuted material, comprising the step of transporting comminuted material into a receptacle of a batch gathering unit by a substantially funnel-shaped array of driven endless flexible non-suction elements.

2. The method of claim 1, wherein at least one of said endless flexible elements is a belt.

3. The method of claim 1, wherein the material is comminuted smokable material.

4. The method of claim 1, further comprising the steps of placing the receptacle beneath the array of flexible elements and positioning the flexible elements of the array in such a way that the flexible elements define a path having a cross-sectional area decreasing downwardly toward the receptacle.

5. The method of claim 1, further comprising the steps of establishing and maintaining a supply of comminuted material within the array of flexible elements, and positioning at least two flexible elements of the array relative to each other at an angle such that the at least two flexible elements loosen the supply of comminuted material within the array.

6. The method of claim 1, further comprising the steps of establishing and maintaining a supply of comminuted material within the array of flexible elements, and loosening the supply within the array.

7. The method of claim 6, wherein said loosening step comprises agitating the comminuted material of the supply by an implement having an at least substantially plate-like agitator affixed to a rotary carrier.

8. The method of claim 1 of transporting comminuted material to an elongated bottom portion of the receptacle having a length at least approximating the length of a rod-shaped smokers' product, further comprising the step of compacting the comminuted material in the bottom portion of the receptacle to form batches having a density at least approximating that of a rod-shaped filler in a rod-shaped smokers' product.

9. The method of claim 8, further comprising the step of evacuating batches from the receptacle into tubular envelopes, including moving the batches substantially longitudinally of the bottom portion.

10. The method of claim 9, wherein the evacuating step includes introducing batches into tubular envelopes containing wrapping material for comminuted smokable material.

11. Apparatus for making batches of comminuted material, comprising a batch gathering unit including a receptacle for comminuted material; and means for transporting comminuted material into said receptacle, including a substantially funnel-shaped array of at least intermittently driven endless flexible non-suction elements.

12. The apparatus of claim 11, wherein at least one of said flexible elements is an endless flexible belt.

13. The apparatus of claim 11, wherein the comminuted material is comminuted smokable material.

14. The apparatus of claim 11, wherein said receptacle is disposed beneath said array and the flexible elements of said array define a path having a cross-sectional area decreasing downwardly toward said receptacle.

15. The apparatus of claim 11, wherein at least two flexible elements of said array are positioned relative to each other at an angle such that said at least two flexible elements loosen a supply of comminuted material within said array.

16. The apparatus of claim 11, wherein the flexible elements of said array define a compartment for a supply of comminuted material and further comprising mobile means for loosening the supply of comminuted material.

17. The apparatus of claim 16, wherein said means for loosening comprises a rotary carrier and a substantially plate-like loosening implement eccentrically affixed to said carrier.

18. The apparatus of claim 11, wherein said transporting means includes means for loosening comminuted material prior to introduction of comminuted material into said receptacle.

19. The apparatus of claim 11, wherein said receptacle includes a bottom portion for batches of comminuted material and further comprising means for compacting batches of comminuted material in said bottom portion to a density at least approximating that of a filler in a rod-shaped smokers' product.

20. The apparatus of claim 11, wherein said receptacle includes an elongated bottom portion for batches of comminuted material and further comprising means for compacting batches of comminuted material in said bottom portion and for evacuating compacted batches from said receptacle at least substantially longitudinally of said bottom portion.

21. The apparatus of claim 20, wherein said means for evacuating includes means for introducing evacuated batches of comminuted material into tubular envelopes having wrapping material for fillers of comminuted smokable material.

22. A method of making batches of comminuted material, comprising the steps of establishing and maintaining a supply of comminuted material within a substantially funnel-shaped array of driven endless flexible elements; and transporting comminuted material from said supply into a receptacle of a batch gathering unit, said transporting step including the steps of at least intermittently driving at least one first flexible element of the array in a first direction at least substantially toward said receptacle, and at least intermittently driving at least one second flexible element of the array in a second direction at least substantially away from said receptacle.

23. A method of making batches of comminuted material, comprising the steps of establishing and maintaining a supply of comminuted material within a substantially funnel-shaped array of driven endless flexible elements; loosening the supply within the array, including agitating the comminuted material of the supply by a rotary eccentric loosening implement; and transporting comminuted material from said supply into a receptacle of a batch gathering unit by said array of driven endless flexible elements.

24. A method of making batches of comminuted material, comprising the steps of transporting comminuted material into a receptacle of a batch gathering unit by a substantially funnel-shaped array of driven endless flexible elements; accumulating a quantity of comminuted material in the receptacle; evacuating batches of comminuted material from the receptacle with attendant depletion of the quantity of comminuted material; monitoring the quantity of comminuted material in the receptacle; and driving the flexible elements to transport comminuted material into the receptacle when the quantity of comminuted material is depleted to a predetermined minimum value.

25. The method of claim 24, wherein said monitoring step includes photoelectronically monitoring the quantity of comminuted material in the receptacle.

26. Apparatus for making batches of comminuted material, comprising a batch gathering unit including a receptacle for comminuted material; and means for transporting comminuted material into said receptacle, including a substantially funnel-shaped array of at least intermittently driven endless flexible elements which define a compartment for a supply of comminuted material, and at least one drive for said flexible elements, said at least one drive including means for at least intermittently driving at least one first flexible element of said array in a first direction at least substantially toward said receptacle, and means for at least intermittently driving at least one second flexible element of said array in a second direction at least substantially away from said receptacle.

27. Apparatus for making batches of comminuted material, comprising a batch gathering unit including a receptacle arranged to accumulate a quantity of comminuted material; means for transporting comminuted material into said receptacle, including a substantially funnel-shaped array of at least intermittently driven endless flexible elements, said unit further including means for evacuating batches of comminuted material from said receptacle with attendant depletion of of the quantity of comminuted material in the receptacle; and means for monitoring the quantity of comminuted material in said receptacle and for activating a drive for said flexible elements to transport comminuted material into said receptacle in response to depletion of the quantity of comminuted material in the receptacle to a predetermined minimum value.

28. Apparatus for making batches of comminuted material, comprising a batch gathering unit including a receptacle for comminuted material; means for varying the capacity of said receptacle; and means for transporting comminuted material into said receptacle, including an at least substantially funnel-shaped array of at least intermittently driven endless flexible elements.

29. A method of making batches of comminuted material, comprising the steps of establishing and maintaining a supply of comminuted material within a substantially funnel-shaped array of driven endless flexible elements; and transporting comminuted material from said supply into a receptacle of a batch gathering unit, said transporting step including the steps of at least intermittently driving at least one first flexible element of the array in a first direction at least substantially toward said receptacle, and at least intermittently driving at least one second flexible element of the array in a second direction other than said first direction, said step of at least intermittently driving the at least one first flexible element including causing the at least one first flexible element to advance from a higher level to a lower level and said step of at least intermittently driving the at least one second flexible element including causing the at least one second flexible element to advance comminuted material from a lower level to a higher level.

30. Apparatus for making batches of comminuted material, comprising a batch gathering unit including a receptacle for comminuted material; and means for transporting comminuted material into said receptacle, including a substantially funnel-shaped array of at least intermittently driven endless flexible elements which define a compartment for a supply of comminuted material, and at least one drive for said flexible elements, said at least one drive including means for at least intermittently driving at least one first flexible element of said array in a first direction at least substantially toward said receptacle, and means for at least intermittently driving at least one second flexible element of said array in a second direction other than said first direction, said means for at least intermittently driving said at least one first flexible element including means for causing said at least one first flexible element to advance comminuted material of said supply from a higher level to a lower level and said means for at least intermittently driving said at least one second flexible element including means for causing said at least one second flexible element to advance comminuted material from a lower level to a higher level.

* * * * *